US007041338B2

(12) United States Patent
Nigam

(10) Patent No.: US 7,041,338 B2
(45) Date of Patent: May 9, 2006

(54) PROCESS FOR PROVIDING A COATED PAPER, A RESIN COATED PAPER, A POLYMERIC FILM, AND A FLEXIBLE OR INFLEXIBLE WOVEN FABRIC SUBSTRATE BY UTILIZING A COATING COMPOSITION CONTAINING A NITROGENOUS DYE-FIXING COMPOUND

(75) Inventor: Asutosh Nigam, Freemont, CA (US)

(73) Assignee: Pixterra, Inc., San Jose, CA (US)

( * ) Notice: Subject to any disclaimer, the term of this patent is extended or adjusted under 35 U.S.C. 154(b) by 263 days.

(21) Appl. No.: 10/138,231

(22) Filed: May 1, 2002

(65) Prior Publication Data

US 2003/0219539 A1 Nov. 27, 2003

(51) Int. Cl.
*B05D 5/04* (2006.01)

(52) U.S. Cl. ..... 427/407.1; 427/411; 427/412; 427/412.1; 427/412.2

(58) Field of Classification Search ..... 427/209, 427/210, 211, 407.1, 411, 412, 412.1, 412.2, 427/412.3, 412.4, 412.5; 162/135, 137; 524/500, 524/523, 521, 516
See application file for complete search history.

(56) References Cited

U.S. PATENT DOCUMENTS

| | | | | |
|---|---|---|---|---|
| 2,661,349 A | | 12/1953 | Caldwell et al. | 260/224 |
| 3,006,806 A | | 10/1961 | Schur | 162/158 |
| 3,058,873 A | | 10/1962 | Keim et al. | 162/164 |
| 3,840,486 A | | 10/1974 | Dumas | 260/29.4 R |
| 4,239,592 A | | 12/1980 | Gaspar et al. | 162/175 |
| 4,478,682 A | | 10/1984 | Bankert et al. | 162/158 |
| 4,740,445 A | * | 4/1988 | Hirai et al. | 430/203 |
| 4,788,134 A | * | 11/1988 | Ozaki et al. | 430/619 |
| 4,872,951 A | | 10/1989 | Maliczyszyn et al. | 162/135 |
| 5,138,669 A | | 8/1992 | Shimura et al. | 382/229 |
| 5,510,004 A | | 4/1996 | Allen | 162/168.2 |
| 5,647,898 A | | 7/1997 | Fuertes et al. | 106/162.1 |
| 5,659,011 A | | 8/1997 | Waldmann | 528/422 |
| 5,709,976 A | | 1/1998 | Malhotra | 430/124 |

FOREIGN PATENT DOCUMENTS

| | | |
|---|---|---|
| EP | 350 668 | 6/1989 |
| EP | 620 315 | 4/1994 |

* cited by examiner

*Primary Examiner*—Timothy Meeks
*Assistant Examiner*—William Phillip Fletcher, III
(74) *Attorney, Agent, or Firm*—Robert G. Lev

(57) ABSTRACT

The present invention provides a process for making a coated substrate such as paper, by utilizing a coating composition containing a nitrogenous dye-fixing compound. The coating compositions utilized in the process contains from 5–95 wt. percent of a film-forming binder mixed with a dye fixing compound, dye fixing polymer or a mixture thereof that includes a dye fixing compound selected from a biguanidine compound, a guanidine oligomer, or a derivative, which is a member selected from the such group consisting of chlorhexidine, chlorguanide, an oligomer of a chlorhexidine or chlorguanidine derivative, or a salt thereof, wherein the ink-receptive surface coating composition or agent may also include at least one organic or inorganic cross-linker, as well as other coating substituents. The coating compositions provide a coated substrate that provides high quality printed images when printed with an ink containing a reactive dye having ionizable and/or nucleophilic groups capable of reacting with the coating agent, and images are bleed-resistant, water-resistant (e.g., water-fast), and/or are characterized by an enhanced chroma and hue.

37 Claims, No Drawings

PROCESS FOR PROVIDING A COATED PAPER, A RESIN COATED PAPER, A POLYMERIC FILM, AND A FLEXIBLE OR INFLEXIBLE WOVEN FABRIC SUBSTRATE BY UTILIZING A COATING COMPOSITION CONTAINING A NITROGENOUS DYE-FIXING COMPOUND

TECHNICAL FIELD

The present invention relates generally to the production of a coated substrate such as paper, and more particularly relates to a novel substrate coating process and novel compositions useful in conjunction therewith.

BACKGROUND

As printing technology advances, paper manufacturers are faced with the increasingly rigorous demands of their customers for high quality paper that is economically attractive. For example, there is a great demand for paper of high enough quality to be suitable for printing of a digital image with an ink-jet printer where the look and feel of the product approaches that of a photograph. Thus, there is a keen demand for papers that meet high quality standards with respect to brightness, opacity, and dry and/or wet strength, and that, upon printing with any of a wide range of colorants, provide a water-resistant printed image. Customers further demand that such papers be amenable to use with a variety of printing techniques, including not only conventional printing techniques, but also "impact free" printing techniques such as inkjet printing (particularly colored inkjet printing), laser printing, photocopying, and the like. In response, paper manufacturers have attempted to meet their customers' demands for such high quality paper through a process termed "sizing." "Sizing," which encompasses both "internal sizing" and "external sizing," affects the manner in which colorants and particularly ink interact with the fibers of the paper. "Internal sizing" involves introduction of sizing compositions within the entire fibrous mass at the pulp stage of paper manufacturing (i.e., to the wet pulp, or more specifically, to the prepared papermaking furnish) before the stock is formed into a sheet, resulting in the distribution of the sizing composition within the entire fibrous mass that is subsequently used to produce the fibrous paper sheet. "External sizing" (also referred to as surface application, pasting, saturating or coating) involves application of a sizing composition to at least one surface of a fibrous paper sheet, so that the composition is present on or in at least one of the two faces of the fibrous sheet. Paper and paper-based products are internally and/or externally sized to increase the resulting paper's strength, resistance to picking and scuffing, and resistance to undue penetration of water, organic solvents, oils, inks, and various types of aqueous solutions. Sizing is also used to improve the paper's smoothness and optical characteristics. In general, sizing is recognized to confer a number of advantages, including but not limited to the foregoing, with perhaps resistance to penetration of water and aqueous inks (e.g., bleed resistance) of utmost importance.

Various materials have been used as external and/or internal sizing agents, such as conventional and modified starches, polyvinyl alcohol, cellulosic derivatives, gelatin, rosin, proteins such as casein, natural gums and synthetic polymers. Internal sizing agents are generally referred to as acid, neutral, or alkaline internal sizes. Acid sizes are typically rosin based and precipitated by alum. Neutral sizes may also be rosin-based, and are used at near-neutral pH, while alkaline sizes are synthetic materials such as alkenyl succinic anhydride (ASA) and alkyl ketene dimer (AKD).

Although these materials are effective to various degrees under certain conditions, use of each is associated with certain limitations. For example, it is often necessary to use large amounts of these conventional sizing agents in order to provide paper having the desired properties. However, the opacity and brightness of the paper substrate decrease in direct proportion to the amount of sizing agent applied to the paper. Moreover, as the amount of sizing agent and/or the cost of the sizing agent increases, the cost of producing the paper increases, making high quality papers prohibitively expensive. Certain sizing agents impart relatively poor bleed resistance and water resistance of imprinted inks, and thus must be used with insolubilizing agents to ensure production of a printed paper having satisfactory water resistance.

In addition, sizing agents usually require multiple application layers, which is time consuming and expensive. Also, beading of water from ink-jet inks can cause a specked or grainy image on the paper when the digital image sent to the printer was much clearer.

Conventional and modified starches are the most common sizing agents in use in the industry. Exemplary starch-based sizing agents include hydrophobic starches (see, e.g., U.S. Pat. No. 2,661,349), blends of hydrophobic and non-hydrophobic starches (see, e.g., U.S. Pat. No. 4,239,592; EP 350,668), and blends of treated starches and/or cationic starches (see, e.g., U.S. Pat. No. 4,872,951; EP 620,315; U.S. Pat. No. 5,647,898). However, while starches may provide improved porosity, these compounds generally do not provide for improved bleed resistance or water resistance of inks printed on the treated paper substrates.

Several synthetic sizing agents are presently available, and may be used in internal sizing and/or external sizing processes. Exemplary synthetic sizing agents include hydrophobic cellulose reactive sizing agents (see, e.g., U.S. Pat. Nos. 4,478,682; 3,840,486), cationic polymers (see, e.g., U.S. Pat. No. 3,006,806), and water-soluble, poly(aminoamide) resins (see, e.g., U.S. Pat. No. 4,478,682). Synthetic compounds have also been used to enhance the dry and/or wet strength of paper (see, e.g., U.S. Pat. Nos. 5,138,669; 3,058,873; 5,510,004; 5,659,011), either at the internal sizing or external sizing steps. However, synthetic sizing agents tend to be expensive, due to both the cost of the starting material and the amount that is required to provide a paper substrate having the desired characteristics.

Use of conventional sizing agents normally results in a decrease in the porosity of the final paper substrate; thus, while the sized paper substrate may have the desired brightness and opacity, it may not provide for a printed image having a suitable optical density or color intensity. In addition, as the porosity of the paper increases, the paper becomes less amenable to various handling processes during manufacturing. For example, envelope manufacturers demand that the paper available to them have a relatively low porosity. If the porosity of the paper is too high, the paper is too stiff for handling by automated industrial devices for folding and sorting (e.g., devices of the "suction extractor" type) during envelope production. In contrast to lower porosity papers, high porosity papers also require slower machine speeds, and further require refining and draining operations that have relatively high energy costs. Both of these requirements result in decreases in plant productivity, efficiency, and cost effectiveness.

Paper manufacturers have also attempted to improve the water resistance of printed images on paper using various coating methods and compositions. For example, U.S. Pat. No. 5,709,976 describes coated paper having a hydrophobic barrier layer, which is composed of a water insoluble component and a water soluble or alcohol soluble anticurl agent, and an image receiving coating on the hydrophobic barrier layer, where the image receiving coating is composed of a polymeric binder, a dye fixative, a lightfastness inducing agent, a filler, and a biocide. While the coated paper provides for printed images having improved water resistance, the preparation of the coated paper requires multiple steps, e.g., a first step to coat the paper with a hydrophobic barrier layer, and then a second step to coat the paper with an image-receiving coating. These additional steps translate to additional manufacturing costs. Moreover, the components of such conventional coating compositions are often quite expensive, further adding to production costs.

There is a need in the field for coating agents and methods that provide an effective, cost efficient means for producing paper that yields a high quality, water-resistant printed image, that are amenable for use with a wide variety of paper substrates, and that are compatible with conventional manufacturing and post-manufacture handling processes. There is a need for agents that lend themselves to even a single coating layer, although multiple layers may be used. There is a particular need for coating agents and their coated substrate where an image printed using an ink-jet mechanism has the look and feel of a photograph produced by conventional photographic printing techniques.

SUMMARY OF THE INVENTION

The present invention provides novel coating methods and coating compositions for a solid substrate, wherein the coating compositions comprise an effective amount of at least one ink receptive surface coating composition or agent selected from the group consisting of:

(a) a dye fixing compound, dye fixing polymer or a mixture thereof selected from the group consisting of:

(a) a dye fixing compound, dye fixing polymer or a mixture thereof selected from the group consisting of:

(i) a monomeric guanidine compound, a biguanidine compound, a guanidine oligomer, or a derivative, which is a member selected from the such group consisting of chlorhexidine, chlorguanide, an oligomer of a chlorhexidine or chlorguanidine derivative, and the like, or a salt thereof, (ii) a polyvinylamidine polymer or a salt thereof, (iii) a mixture of (i) and a polyvinylamidine polymer or salt thereof, (iv) a mixture (i) and a guanidine polymer, or a salt thereof, (v) a mixture of a guanidine polymer, or a salt thereof, and a polyvinylamidine polymer or a salt thereof, and (vi) a mixture of (ii), a guanidine polymer or a salt thereof, and a polyvinylamidine polymer or a salt thereof, and (b) from 5–95 wt. percent of a film forming binder;

wherein the ink-receptive surface coating composition or agent of (i)–(vi) may also include at least one organic or inorganic cross-linker, wherein the term polymer refers to a compound having a molecular weight between 2,000 and 200,000, and wherein the salt of the basic nitrogenous moiety of the dye-fixing compound or polymer forms a quaternary ammonium salt, or forms a mixed metallic cation amine salt, with a counter ion selected from the group consisting of an organic or inorganic anion. When applied to one or both sides of a substrate such as a sized paper substrate, the coating compositions provide a coated paper substrate that yields high quality printed images when printed with an ink containing a reactive dye having ionizable and/or nucleophilic groups capable of reacting with the coating agent. Images printed on a paper substrate coated with the coating composition of the invention are bleed-resistant, water-resistant (e.g., water-fast), and/or are characterized by an enhanced chroma and hue. Such images sometimes take on the look and feel of a photograph that is produced by conventional photographic processes.

It is a primary object of the invention to address the above-mentioned need in the art by providing a coating composition that efficiently binds colorant upon printing, and thus provides an economical, efficient means for processing of paper to provide a high quality printed image thereon.

Another object of the invention is to provide a printed, coated paper substrate on which the printed image is high quality (particularly with respect to optical density and brightness), bleed-resistant and water-resistant.

Still another object of the invention is to provide a method for coating paper using the coating compositions of the invention.

Still an additional object of the invention is to provide a method for printing on a coated paper substrate to provide water-resistant (e.g., water-fast) images thereon.

Additional objects, advantages and novel features of the invention will be set forth in part in the description which follows, and in part will become apparent to those skilled in the art upon examination of the following, or may be learned by practice of the invention.

DETAILED DESCRIPTION OF THE INVENTION

Definitions and Nomenclature

It must be noted that, as used in the specification and the appended claims, the singular forms "a," "an" and "the" include plural referents unless the context clearly dictates otherwise. Thus, for example, reference to "a monomeric guanidine compound, a biguanidine compound or a guanidine oligomer" in a composition means that more than one guanidine compound or oligomer or more then one biguanidine compound, or a mixture thereof, can be present in the composition, reference to "a film-forming binder" in a composition means that more than one film-forming binder can be present in the composition, reference to "a guanidine oligomer or biguanidine compound" includes combinations of different guanidine oligomers as well as mixtures of biguanidine compounds or guanidine or a combination thereof, reference to "a coating agent' includes mixtures of different coating agents, and the like.

The term "paper" or "paper substrate" is meant to encompass any substrate based on cellulosic fibers; synthetic polymer films and fibers such as polyamides, polyesters, polyethylene, and polyacrylic; inorganic fibers such as asbestos, ceramic, and glass fibers; and any combination of cellulosic, synthetic, and inorganic fibers or a combination of cellulosic fiber and synthetic polymer films produced by extrusion or coating the cellulosic fiber substrate. The paper or paper substrate can be composed of compressed natural or synthetic fibers, of compressed natural or synthetic solids, or of a woven appearance such as a textile or canvas. The paper or paper substrate may be an opaque or a see-through substrate such as used with an overhead projector, and the substrate may be of any dimension (e.g., size or thickness) or form (e.g., pulp, wet paper, dry paper, etc.). Also, the paper or paper substrate can have a smooth or textured appearance, e.g., a canvas-look texture. In most instances, the "paper" or "paper substrate" has been subjected to an external sizing process prior to treatment according to the methods of the invention, however sizing is not required. The paper substrate is preferably in the form of a flat or sheet structure, which structure may be of variable dimensions (e.g., size and thickness). "Paper" is meant to encompass printing paper (e.g., inkjet printing paper, etc.), writing paper, drawing paper, and the like, as well as board materials such as cardboard, poster board, Bristol board, and the like.

The term "sheet" or "flat structure" is not meant to be limiting as to dimension, roughness, or configuration of the substrate useful with the present invention, but rather is meant to refer to a product suitable for coating. A sheet or flat structure can refer to a substrate having either a substantially smooth or a textured appearance, e.g., a canvas-look texture.

"Sized paper substrate" is a paper substrate as described above that has applied to its surface and/or is saturated with a sizing composition. Sizing compositions may be applied in an internal sizing step and/or in an external sizing step; preferably sizing (e.g., internal and/or external sizing) occurs prior to application of the coating composition of the invention.

"Polymer coating composition," "coating composition," or "top coat composition" as used herein generally refer to a composition that is minimally composed of an effective amount of at least one ink receptive surface coating composition or agent selected from the group consisting of:

(a) a dye fixing compound, dye fixing polymer or a mixture thereof selected from the group consisting of:
  (i) a monomeric guanidine compound, a biguanidine compound, a guanidine oligomer, or a derivative, which is a member selected from the such group consisting of chlorhexidine, chlorguanide, an oligomer of a chlorhexidine or chlorguanidine derivative, and the like, or a salt thereof,
  (ii) a polyvinylamidine polymer or a salt thereof,
  (iii) a mixture of (i) and a polyvinylamidine polymer or salt thereof,
  (iv) a mixture (i) and a guanidine polymer, or a salt thereof,
  (v) a mixture of a guanidine polymer, or a salt thereof, and a polyvinylamidine polymer or a salt thereof, and
  (vi) a mixture of (ii), a guanidine polymer or a salt thereof, and a polyvinylamidine polymer or a salt thereof, and (b) from 5–95 wt. percent of a film forming binder;

wherein the ink-receptive surface coating composition or agent of (i)–(vi) may also include at least one organic or inorganic cross-linker, wherein the term polymer refers to a compound having a molecular weight between 2,000 and 200,000, and wherein the salt of the basic nitrogenous moiety of the dye-fixing compound or polymer forms a quaternary ammonium salt, or forms a mixed metallic cation amine salt, with a counter ion selected from the group consisting of an organic or inorganic anion.

"Coated paper substrate" is a paper substrate that has applied to its surface and/or is saturated with a coating composition of the invention. Coating compositions may be applied as a pretreatment (e.g., prior to printing), simultaneously with printing, or as an after-treatment. The coating compositions of the invention are applied in quantities suitable to provide the desired characteristics, such as bleed resistance, water resistance (e.g., water-fastness) of an ink printed on coated paper substrate, etc. Multiple coatings may be applied, but one embodiment consists of a single application of the coating composition on one or both sides of a substrate to produce a high quality coated paper substrate.

"Aqueous based ink" refers to an ink composed of an aqueous carrier medium (or composed of a mixed solvent medium such as a mixture of aqueous and aqueous miscible organic solvents) and a colorant, such as a dye or a pigment dispersion. An "aqueous carrier medium" is composed of water or a mixture of water and one or more water-soluble organic solvents. Exemplary aqueous based ink compositions are described in detail below.

"Colorant" as used herein is meant to encompass one or more organic dyes, inorganic dyes, pigments, stains, and the like compatible for use with the polymer coatings of the invention. A colorant may be in the RGB scale, the CMY scale, or simply a white or black opaque pigment. Examples of opaque pigments are aluminas, silicas, and titanium oxide. Examples of organic pigments are micronized organic polymers that are usually not soluble in water.

The term "colorant-reactive component" as used herein refers to a component (e.g., a chemical moiety) of a coating agent that is capable of reacting with a selected colorant, particularly a colorant having a nucleophilic and/or ionizable group, to form a coating agent-colorant complex. The coating agent-colorant complex is formed through either a covalent, electrostatic, or ionic association between the colorant-reactive component of the coating agent and the colorant. When a coating agent having a colorant-reactive component and a selected colorant from a coating agent-colorant complex in the context of a printed image on a coated paper substrate, the association between the colorant and the color-reactive component of the coating agent is effective to impart advantageous qualities to the printed image on the coated paper substrate, particularly with respect to water resistance, enhanced optical density, enhanced brightness, and the like.

The term "organic solvent" is used herein in its conventional sense to refer to a liquid organic compound, typically a monomeric organic material in the form of a liquid, preferably a relatively non-viscous liquid, the molecular structure of which contains hydrogen atoms, carbon atoms, and optionally other atoms as well, and which is capable of dissolving solids gases or liquids.

The terms "significant" or "significantly", as when used with reference to "significantly enhanced brightness" or "significantly improved water-fastness" generally refer to a difference in a quantifiable, measurable, or otherwise detectable parameter, e.g., optical density, LAB graphs (color sphere), dot spread, bleed through, between the two groups being compared (e.g., uncoated versus coated paper substrates) that is statistically significant using standard statistical tests. For example, the degree of visual wicking or water-fastness in a coated paper substrate as detected in a print assay may be quantified using standard methods, and the degree of wicking or water-fastness under different conditions can be compared for both coated and uncoated paper substrates to detect statistically significant differences.

Photograph-like quality "look and feel", when used herein refers to a printed substrate wherein the image is substantially free of the type of speckling or graininess that is usually caused by uneven absorption (or by incomplete absorption) of water soluble inks into the substrate after printing and before drying, and may be glossy, dull or semi-glossy in appearance based upon the desired result and the desired coating composition.

The term "fluid resistance" is used herein to describe the resistance of a paper substrate to penetration by a fluid, with the term "water resistance" specifically referring to resistance of a paper substrate to penetration by a fluid.

The term "water-fast," is used herein to describe a form of water resistance, and which is normally used to refer to the nature of the ink composition after drying on a substrate. In general, "water-fast" means that the dried composition is substantially insoluble in water, such that upon contact with water, the dried ink retains at least about 70%, preferably at least about 85%, and more preferably at least about 95%, of optical density.

The term "bleed resistance" is meant to refer to the retardation of the penetration of water into paper, which retardation is associated with creation of a low energy hydrophobic surface at the fiber-water interface which increases the contact angle formed between a drop of liquid and the surface, and thus decreases the wettability. Contact angles have been shown to be sensitive to molecular packing, surface morphology, and chemical constitution of the paper substrate and any components added thereto.

The term "rub resistance" is normally meant to refer to a characteristic of the ink composition after drying on a substrate, more specifically, the ability of a printed image to remain associated with the substrate upon which it is printed despite application of force (e.g., rubbing) to the printed image. In general, "rub resistant" means that the dried ink composition is substantially resistant to rubbing force so that the dried ink retains at least about 70%, preferably at least about 85%, and more preferably at least about 95%, of optical density after rubbing of the printed image.

The term "alkyl" as used herein refers to a branched or unbranched saturated hydrocarbon group of 1 to 24 carbon atoms, such as methyl, ethyl, n-propyl, isopropyl, n-butyl, isobutyl, t-butyl, octyl, decyl, tetradecyl, hexadecyl, eicosyl, tetracosyl and the like, as well as cycloalkyl groups such as cyclopentyl, cyclohexyl and the like. The term "lower alkyl" intends an alkyl group of 1 to 6 carbon atoms, preferably 1 to 4 carbon atoms.

The term "alkylene" as used herein refers to a difunctional, branched or unbranched saturated hydrocarbon group of 1 to 24 carbon atoms, including without limitation methylene, ethylene, ethane-1,1-diyl, propane-2,2-diyl, propane-1,3-diyl, butane-1,3-diyl, and the like. "Lower alkylene" refers to an alkylene group of 1 to 6 carbon atoms.

The term "alkoxy" as used herein intends an alkyl group bound through a single, terminal ether linkage; that is, an "alkoxy" group may be defined as ——OR where R is alkyl as defined above. A "lower alkoxy" group intends an alkoxy group containing 1 to 6 carbon atoms.

"Halo" or "halogen" refers to fluoro, chloro, bromo or iodo, and usually relates to halo substitution for a hydrogen atom in an organic compound.

The term "polymer" is used herein in its conventional sense to refer to a compound having about 8 or more monomer units, and unless otherwise stated, refers to a compound having a molecular weight from about 2,000 to about 200,000. The term "oligomer" refers to a compound having from 2 to about 8 monomer units. The terms oligomer and polymer intend to cover compounds having a single type of repeating monomer unit (homopolymer or oligomer) as well as compounds containing more than one type of monomer unit (copolymers and mixed oligomers). The terms "monomer" or "monomeric" as used herein refer to compounds which are not polymeric or oligomeric as defined above.

The terms "guanidine polymer" and "polyvinylamidine polymer" as used herein each have a molecular weight from about 2,000 to about 200,000. The structures for these polymer compounds are structures such as those defined in U.S. Pat. No. 6,197,880, issued Mar. 6, 2001, which are incorporated herein by reference, or polymers having similar structures.

"Optionally" or "optionally" means that the subsequently described event or circumstance may or may not occur, and that the description includes instances where said event or circumstance occurs and instances where it does not. For example, the phrase "optionally substituted" aromatic ring means that the aromatic ring may or may not be substituted and that the description includes both an unsubstituted aromatic ring and an aromatic ring bearing one or more substituents.

Overview of the Invention

The present invention is based upon the discovery that a composition containing a coating composition or coating agent comprising an effective amount of at least one ink receptive surface coating composition or agent selected from the group consisting of:

(a) a dye fixing compound, dye fixing polymer or a mixture thereof selected from the group consisting of:
  (i) a monomeric guanidine compound, a biguanidine compound, a guanidine oligomer, or a derivative, which is a member selected from the such group consisting of chlorhexidine, chlorguanide, an oligomer of a chlorhexidine or chlorguanidine derivative, and the like, or a salt thereof,
  (ii) a polyvinylamidine polymer or a salt thereof,
  (iii) a mixture of (i) and a polyvinylamidine polymer or salt thereof,
  (iv) a mixture (i) and a guanidine polymer, or a salt thereof,
  (v) a mixture of a guanidine polymer, or a salt thereof, and a polyvinylamidine polymer or a salt thereof, and
  (vi) a mixture of (ii), a guanidine polymer or a salt thereof, and a polyvinylamidine polymer or a salt thereof, and (b) from 5–95 wt. percent of a film forming binder;

wherein the ink-receptive surface coating composition or agent of (i)–(vi) may also include at least one organic or inorganic cross-linker, wherein the term polymer refers to a compound having a molecular weight between 2,000 and 200,000, and wherein the salt of the basic nitrogenous moiety of the dye-fixing compound or polymer forms a quaternary ammonium salt, or forms a mixed metallic cation amine salt, with a counter ion selected from the group consisting of an organic or inorganic anion, is effective in coating a sized paper substrate to provide numerous advantages. Coated paper substrate that has been treated with a coating composition of the invention yields high quality printed images having improved color fastness (the printed images do not run when exposed to moisture) as a result of the substantially non-reversible binding of aqueous colorants to the coating agent present in the coating composition. These images are therefore characterized as "water-resistant" or "water-fast" due to the characteristics of the printed image following exposure to water. Often the printed images is substantially similar to the look and feel of a photographic image.

The coated paper substrates of the invention can be used in conventional printing, or with digital printing (particularly inkjet printing, including drop-on-demand printing and continuous printing) to provide highly brilliant, printed images that are significantly improved in color quality (for example, with respect to chroma and hue) when compared to uncoated paper substrates and/or to paper substrates coated with conventional coating compositions.

The coating compositions and their methods of use according to the present invention thus provide a number of advantages over conventional sizing and coating methods, and sizing and coating compositions.

The coating compositions, methods of coating using the coating compositions described herein, and other features of the invention are described in greater detail below.

Coating Compositions

The coating compositions of the invention are composed of a coating composition or coating agent comprising an effective amount of at least one ink receptive surface coating composition or agent selected from the group consisting of:

(a) a dye fixing compound, dye fixing polymer or a mixture thereof selected from the group consisting of:
  (i) a monomeric guanidine compound, a biguanidine compound, a guanidine oligomer, or a derivative, which is a member selected from the such group consisting of chlorhexidine, chlorguanide, an oligomer of a chlorhexidine or chlorguanidine derivative, and the like, or a salt thereof,
  (ii) a polyvinylamidine polymer or a salt thereof,
  (iii) a mixture of (i) and a polyvinylamidine polymer or salt thereof,
  (iv) a mixture (i) and a guanidine polymer, or a salt thereof,
  (v) a mixture of a guanidine polymer, or a salt thereof, and a polyvinylamidine polymer or a salt thereof, and
  (vi) a mixture of (ii), a guanidine polymer or a salt thereof, and a polyvinylamidine polymer or a salt thereof, and (b) from 5–95 wt. percent of a film forming binder;

wherein the ink-receptive surface coating composition or agent of (i)–(vi) may also include at least one organic or inorganic cross-linker, wherein the term polymer refers to a compound having a molecular weight between 2,000 and 200,000, and wherein the salt of the basic nitrogenous moiety of the dye-fixing compound or polymer forms a quaternary ammonium salt, or forms a mixed metallic cation amine salt.

In general, the coating agents have a colorant-reactive component, which is capable of reacting with a selected colorant, particularly a colorant having a nucleophilic and/or ionizable group, to form a coating agent-colorant complex through a covalent, electrostatic, or ionic association. The association of the coating agent and colorant imparts bleed resistance, water resistance (e.g., water-fastness), and other desirable characteristics to the printed coated paper substrate. In addition to the coating agent, the coating compositions can include components such as binders, pigments, and other additives.

The coating compositions of the invention can be readily prepared from commercially available starting materials and/or reagents, are compatible with additional binders or additives, can be used with a variety of base papers, and are compatible with a variety of printing methods, including conventional and digital printing methods (particularly inkjet printing, including drop-on-demand printing and continuous printing), and can also be used with existing commercial paper production processes and equipment. The coating composition is inexpensive to prepare, and relatively small amounts are required to provide a coated paper substrate having the advantageous features described herein. The coating compositions of the invention are also easy to handle due to their solubility in water (the active components, the coating agents, are hydrophilic polymers), and do not require the use of large volumes of organic solvents. The novel coating compositions herein also possess good film-forming properties.

The coated paper substrate prepared using the composition of the invention exhibits improved durability, as evidenced by improved paper strength (e.g., tear strength), and stability upon prolonged storage. The coated paper does not discolor or yellow, and maintains a high degree of brightness for extended periods of time. Paper substrates treated with the coating compositions of the invention react rapidly and, in some embodiments, irreversibly with a number of aqueous based colorants, thus providing a versatile coating system for use with a wide variety of available colorants. Furthermore, because the colorant reacts quickly with the coating compositions, the coated printed substrate does not require a separate curing step, but rather is fast-drying. This fast-drying characteristic provides for printed images that are "non-sticky," thus allowing the printed coated paper substrate to be handled immediately after printing, e.g., to allowing stacking. The coated paper substrate of the invention can also be used to prepare images with varying degrees of gloss, depending upon variations in pigment.

In addition to their water resistance, paper substrates coated with a coating composition of the invention are highly bleed-resistant (as evidenced by small dot size measurements, i.e., less wicking action) and rub-resistant.

Embodiment of the present invention processes, compositions, methods for applying the compositions, and resulting substrates are described as follows.

In one embodiment the invention provides a process for coating a solid substrate selected from the group consisting of paper, resin-coated paper, polymeric films, and flexible or inflexible woven fabric sheets, comprising applying to one or both surfaces of the substrate a coating composition comprising an effective amount of at least one ink receptive surface coating composition or agent selected from the group consisting of:

(a) a dye fixing compound, dye fixing polymer or a mixture thereof selected from the group consisting of:
  (i) a monomeric guanidine compound, a biguanidine compound, a guanidine oligomer, or a derivative, which is a member selected from the such group consisting of chlorhexidine, chlorguanide, an oligomer of a chlorhexidine or chlorguanidine derivative, and the like, or a salt thereof,
  (ii) a polyvinylamidine polymer or a salt thereof,
  (iii) a mixture of (i) and a polyvinylamidine polymer or salt thereof,
  (iv) a mixture (i) and a guanidine polymer, or a salt thereof,
  (v) a mixture of a guanidine polymer, or a salt thereof, and a polyvinylamidine polymer or a salt thereof, and (vi) a mixture of (ii), a guanidine polymer or a salt thereof, and a polyvinylamidine polymer or a salt thereof, and (b) from 5–95 wt. percent of a film forming binder;

wherein the ink-receptive surface coating composition or agent of (i)–(vi) may also include at least one organic or inorganic cross-linker, wherein the term polymer refers to a compound having a molecular weight between 2,000 and 200,000, and wherein the salt of the basic nitrogenous moiety of the dye-fixing compound or polymer forms a quaternary ammonium salt, or forms a mixed metallic cation amine salt, with a counter ion selected from the group consisting of an organic or inorganic anion.

In a preferred embodiment the above process utilizes a coating composition wherein the dye fixing compound is a member selected from the group consisting of Formula I or Formula II (I)

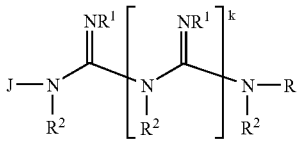

and (II)

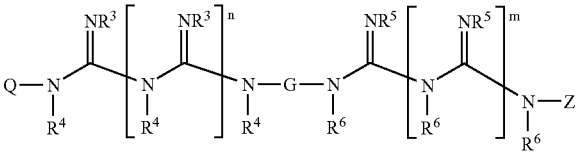

wherein, k, n and m are each independently an integer from 0–4,

J, Q and Z are each independently a monocarbocyclic or bicyclic carbocyclic aromatic group which can be substituted by 1 to 5 members selected from the group consisting of hydrogen, hydroxyl, halo, alkoxy, alkyl, amino, carboxy, acetoxy, cyano and sulfhydryl, G is a bivalent $C_1$–$C_{12}$ straight or branched chain alkyl, alkenyl or alkynyl linking group which can be substituted in the carbon chain by 1 to 4 members selected from the group consisting of O, S, N atoms and 1–12 of the hydrogen atoms on the carbon chain may be replaced independently by a member selected from the group consisting of hydroxyl, halo, alkoxy, alkyl, amino, carboxy, acetoxy, cyano and sulfhydryl, R is a $C_1$–$C_{12}$ straight or branched chain alkyl, alkenyl, alkynyl or alkanoyl group, and 1–12 of the hydrogen atoms on the carbon chain may be replaced independently by a member selected from the group consisting of hydroxyl, halo, alkoxy, alkyl, amino, carboxy, acetoxy, cyano and sulfhydryl, $R^1$, $R^3$ and $R^5$ are each independently hydrogen or lower alkyl, and $R^2$, $R^4$ and $R^6$ are each independently hydrogen, alkyl, alkoxy or hydroxyl-substituted alkyl, or a salt thereof.

A preferred coating composition or agent comprises an effective amount of chlorhexidine, or a salt thereof as the ink receptive surface coating composition or agent. Some examples of the chlorhexidine salts are the dihydrochloride salt that is sold under the brand name Lisium, the diacetate salt that is sold under the brand name Chlorasept 2000, and the chlorhexidine digluconate salt that is sold under brand names such as Bacticlens, Corsodyl, Hibiclens, Hibidil, Hibiscrube, Hibitane, Orahexal, Peridex and the like. A particularly preferred chlorhexidine salt is the chlorhexidine digluconate salt.

Preferred salts of the ink-receptive surface coating composition or agent are wherein the anion of the salt is an anion of an organic acid. Particularly preferred anion groups are alkanoyl groups, in particular when the anion group is gluconate or a gluconate derivative. General examples of anion groups are halide, hydrogen sulfate, acetate, methane sulfonate, succinate, citrate, malonate, furarate, oxylate, gluconate or a gluconate derivative.

Preferred compounds of Formula I and Formula II as described above are compounds, wherein each of J, Q and Z is a member selected from the group consisting of phenyl substituted by 1 to 3 members selected from the group consisting of hydrogen, hydroxyl, halo, alkoxy, alkyl, amino, carboxy, acetoxy, cyano and sulfhydryl, and n and m are each the integer 1, or a salt thereof.

Preferred dye fixing compounds as described above have the following formula:

(II)

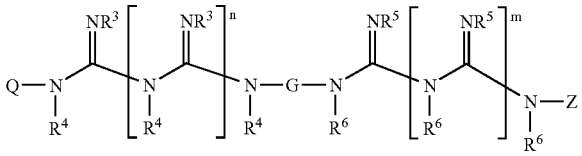

wherein each of Q and Z is a member selected from the group consisting of phenyl substituted by 1 to 3 members selected from the group consisting of hydrogen, hydroxyl, halo, alkoxy, alkyl, amino, carboxy, acetoxy, cyano and sulfhydryl, and each of n and m is the integer 1, or a salt thereof. And, more preferred are such compounds wherein each of Q and Z is a member selected from the group consisting of phenyl substituted in by 1 member selected from the group consisting of hydrogen, hydroxyl, halo, alkoxy, alkyl, amino, carboxy, acetoxy, cyano and sulfhydryl, or a salt thereof. Even more preferred are such compounds wherein each of $R^3$, $R^4$, $R^5$ and $R^6$ is hydrogen and each of Q and Z is a phenyl group substituted in the para position by a halo group, or a salt thereof.

One embodiment of such dye fixing compounds, are such compounds having the following formula:

(II)a

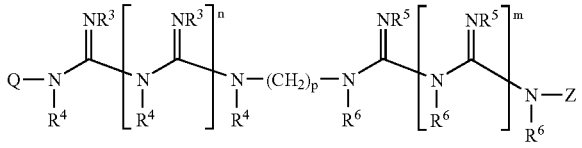

wherein each of Q and Z is a member selected from the group consisting of phenyl substituted by 1 to 3 members selected from the group consisting of hydrogen, hydroxyl, halo, alkoxy, alkyl, amino, carboxy, acetoxy, cyano and sulfhydryl, and p is an integer from 1–20, or a salt thereof.

Preferred are such compounds wherein each of $R^3$, $R^4$, $R^5$ and $R^6$ is hydrogen, p is an integer from 4–8, and each of Q and Z is a phenyl group substituted in the para position by a halo group, or a salt thereof. More preferred are such compounds wherein each of Q and Z is a phenyl group substituted in the para position by a chloro group, p is the integer 6, or a salt thereof.

Another embodiment of the dye fixing compounds according to the invention are compounds having the following formula:

(I)

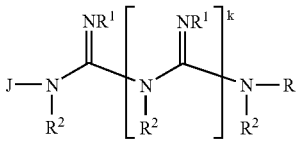

wherein:

k is the integer from 0–4,

J is a member selected from the group consisting of phenyl substituted by 1 to 3 members selected from the group consisting of hydrogen, hydroxyl, halo, alkoxy, alkyl, amino, carboxy, acetoxy, cyano and sulfhydryl, R is a $C^1$–$C^{12}$ straight or branched chain alkyl group, or a salt thereof.

Preferred compounds of formula I as described above are compounds wherein each of $R^1$ and $R^2$ is hydrogen, J is a phenyl group substituted in the para position by a halo group, and R is a member selected from the group consisting of a methyl group, an ethyl group, an n-propyl group, an isopropyl group, an n-butyl group, a t-butyl group, an n-pentyl group, an amyl and an isoamyl group, k is the integer 1, or a salt thereof. More preferred are such compounds wherein J is a phenyl group substituted in the para position by a chloro group, and R is an isopropyl group, or a salt thereof.

An example of a compound according to formula I is chlorguanide, also known by the names Diguanyl, Drinupal, Guanatol, Palusil and the like (see the Merck Index of Organic Compounds at Compound 2088). The hydrochloride salt has the brand name Paludrine and is useful in commerce as an antimalarial agent. Particularly preferred for the present invention is a glutarate or a glutarate derivative salt of chlorguanide.

Other nitrogenous dye-fixing agents are also useful in the present invention. Examples of such compounds are polyamidine (PVAD) and polyvinylamine (PVAM) compounds. Esprit Chemicals, www.espritchem.com (Tele. 941-355-5100, 1-800-237-7748, fax 941-358-1339) provides two vinylamide type polymers PVAM-0595B, a homopolymer of vinyl amine and PVAD-L, a copolymer of vinyl amine and acrylonitrile. Preferred compounds are the alkanoyl salts of these polymers such as gluconate or gluconate derivative salts. The PVAM and PVAD polymers tend to form amides when reacted with acids and may be utilized in the present invention.

Examples of PVAM and PVAD polymeric structures are shown below.

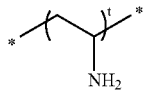

Polyvinylamine
PVAM

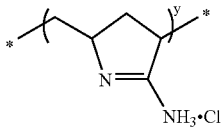

Polyamidine
PVAD

Nitrogenous dye-fixing agents having similar properties to the above compounds may be utilized in the present invention.

In one embodiment the present invention relates to the above described coating compositions wherein the film forming binder comprises a 2-hydroxyethylmethacrylate copolymer or terpolymer or their derivatives. Preferred are compositions wherein the 2-hydroxyethylmethacrylate copolymer or terpolymer is at least one member of the group consisting of 2-hydroxyethylmethacrylate/co-acrylic acid copolymer, 2-hydroxyethylmethacrylate/methacrylic acid copolymer, 2-hydroxyethylmethacrylate/dimethylaminopropylmethacrylate copolymer, 2-hydroxyethylmethacrylate/dimethylaminoethylmethacrylate copolymer, 2-hydroxyethylmethacrylate/dimethylaminoethylmethacrylate copolymer, 2-hydroxyethylmethacrylate/vinylpyrrolidone copolymer, and the like or a quaternary ammonium derivative salt thereof.

In one embodiment the film forming binder further comprises at least one additional film forming binder selected from the group consisting of (a) polyvinyl alcohol or a copolymers comprising vinyl alcohol monomer units, (b) polyvinylpyrrolidone or a copolymer comprising vinylpyrrolidone monomer units, (c) cellulose or a cellulose derivative, (d) starch or a starch derivative, (e) a vinyl acetate polymer or a copolymer comprising vinyl acetate monomer units, (f) polyethyloxazoline, (g) dimethylaminoethylmethacrylate, and (h) dimethylaminopropylmethacrylate, or a quaternary ammonium salt thereof.

In an embodiment of the present invention as described above, the cross-linking agent, when present is one or more members selected from the group consisting of:

(a) the organic cross-linking agent, when present, is at least one member of the group consisting of a polyamide-epichlorhydrin resin, an epoxy resin composition, an azridine compound or salt, an azeridinium compound, and the like, and (b) the inorganic cross-linking agent, when present, is a member selected from the group consisting of a zirconium compound and boron compounds, and the like.

Preferred cross-linking agents are agents wherein the polyamide-epichlorhydrin resin is an azetidinium resin, the zirconium compound is ammonium zirconium carbonate or zirconium acetate, and the boron compound is boric acid.

Preferred coating compositions are aqueous (as defined above) coating compositions, and more preferred are such compositions having the formula I and formula II. More preferred are compositions having the formula 11(a) as described above.

Preferred coating compositions are compositions wherein the film-forming binder is present in an amount from 30 wt. % to 75 wt. % based upon the dry weight of the coating composition. More preferred are such compositions wherein the film-forming binder is present in an amount from about 45 wt. % to about 95 wt. % of the coating composition, and even more preferred are compositions wherein the film-forming binder is present in an amount from about 75 wt. % to 95 wt. % of the coating composition.

In one preferred embodiment, the dye fixing agent is at least one compound of Formula I or Formula II as described above and the film-forming binder in the coating composition is present in an amount from 30 wt. % to 75 wt. % based upon the dry weight of the coating composition. Preferred are such compositions wherein the film-forming binder is present in an amount from about 45 wt. % to about 95 wt. % of the coating composition, and more preferably from about 75 wt. % to about 95 wt. % of the coating composition.

In one embodiment the film-forming binder is selected from the group consisting of polysaccharides, polypeptides, synthetic vinyl polymers, cationic film-forming binders, and derivatives thereof. Preferred polysaccharide binders are selected from the group consisting of starch, a cellulosic polymer, dextran and the like. Preferred polypeptide binders are selected from the group consisting of collagen and gelatin. Preferred synthetic film-forming binders are a member selected from the group consisting of a synthetic vinyl polymer or polyethyloxazoline monomer units. Preferred synthetic vinyl polymers are selected from the group consisting of poly(vinyl alcohol), poly(vinyl phosphate), poly (vinyl pyrrolidone), vinyl-pyrrolidone-vinyl acetate copolymers, vinyl acetate-acrylic acid copolymers, vinyl alcohol-vinyl acetate copolymers, vinyl pyrrolidone-styrene copolymers, poly(vinylamine) and polyethyloxazoline, or a quaternary salt thereof. A more preferred synthetic vinyl polymer binder is a vinyl pyrrolidone-styrene copolymer or quaternary salts thereof.

Preferred film forming binders comprise at least one cationic film-forming binder. More preferred cationic film-forming binders are quaternized members selected from the group consisting of a vinyl pyrrolidone-dimethylaminoethylmethacrylate copolymer, dimethyl-aminoethylmethacrylate-co-methyl methacrylate, 2-hydroxyethylmethacrylate-dimethyl-aminoethylmethacrylate, 2-hydroxypropylmethacrylate-dimethylaminoethyl-methacrylate, polydiallyldimethyl ammonium chloride and quaternized aminoacrylate polymers. Even more preferred is the cationic film-forming binder which is a salt having as the anion counter-ion a member selected from the group consisting of halide, hydrogen sulfate, acetate, methane sulfonate, succinate, citrate, malonate, fumarate, oxylate, gluconate or a gluconate derivative. Most preferred is where such cationic film-forming binder salts have the anion of the salt as gluconate or a gluconate derivative.

In one embodiment the coating composition according to the invention further includes a colorant or pigment, particularly silicas, aluminas, titanium dioxide, and the like. The colorant or pigment can be a white or black opaque pigment.

In a preferred embodiment of the invention, the ink receptive coating composition or agent represents approximately 5 wt. % to 95 wt. % of the coating composition, based upon total solids weight of the composition after drying.

In one embodiment the present invention provides an optionally pre-sized paper product coated by the coating composition as described above. In a preferred embodiment, the optionally pre-sized paper product is coated with a coating composition comprising a compound according to Formula I and Formula II as described above.

In one embodiment the present invention provides an optionally pre-sized paper product coated by the coating composition as described above wherein the ink receptive surface coating agent or composition comprises a member selected from the group consisting of chlorhexidine or a salt thereof, chlorguanide or a salt thereof, PVAM or a salt thereof, PVAD or a salt thereof, or mixtures of two or more of these. In a more preferred embodiment, the optionally pre-sized paper product is coated with a coating composition comprising a gluconate or gluconate salt of a compound selected from the group consisting of chlorhexidine or a salt thereof, chlorguanide or a salt thereof, PVAM or a salt thereof, PVAD or a salt thereof, or mixtures of two or more of these.

In one embodiment the present invention provides a coating composition comprising an aqueous formulation (where aqueous is defined as above to optionally contain one or more aqueous miscible organic solvents) of at least one colorant or pigment and an effective amount of at least one ink receptive surface coating composition or agent selected from the group consisting of a dye fixing compound, dye fixing polymer or a mixture thereof selected from the group consisting of:

(i) a guanidine compound, a biguanidine compound, oligomer, or a derivative, which is a member selected from the such group consisting of chlorhexidine, chlorguanide, an oligomer of a chlorhexidine or chlorguanidine derivative, and the like, or a salt thereof, (ii) a polyvinylamidine polymer or a salt thereof, (iii) a mixture of (i) and a polyvinylamidine polymer or salt thereof, (iv) a mixture (i) and a guanidine polymer, or a salt thereof, (v) a mixture of a guanidine polymer, or a salt thereof, and a polyvinylamidine polymer or a salt thereof, and (vi) a mixture of (ii), a guanidine polymer or a salt thereof, and a polyvinylamidine polymer or a salt thereof, and (b) from 5–95 wt. percent of a film forming binder;

wherein the ink-receptive surface coating composition or agent of (i)–(vi) may also include at least one organic or inorganic cross-linker, and wherein the salt of the basic nitrogenous moiety of the dye-fixing compound or polymer forms a quaternary ammonium salt, or forms a mixed metallic cation amine salt, with a counter ion selected from the group consisting of an organic or inorganic anion.

One embodiment of the coating composition as described above is wherein the ink receptive surface coating composition or agent represents approximately 1 wt. % to 95 wt. % of the composition after drying on a substrate, the film-forming binder represents approximately 10 wt. % to 95 wt. % of the composition after drying on a substrate, and the colorant or pigment represents approximately 10 wt. % to 90 wt. % of the composition after drying on a substrate. More preferred are such coating compositions wherein the film-forming binder represents from about 45 wt. % to about 95 wt. % (or from about 75 wt. % to about 95 wt. %) of the composition after drying on a substrate. Also preferred is a coating composition as described above wherein the ink receptive surface coating composition or agent represents approximately 1 wt. % to 50 wt. % of the composition after drying on a substrate, the film-forming binder represents approximately 45 wt. % to 95 wt. % (or from about 75 wt. % to about 95 wt. %) of the composition after drying on a substrate, and the colorant or pigment represents approximately 10 wt. % to 90 wt. % of the composition after drying on a substrate. The pigment in the coating composition may also be a black or white opaque pigment composition.

A preferred embodiment of such coating compositions as described above are wherein the dye fixing compound is a member selected from the group consisting of Formula I or Formula II (I)

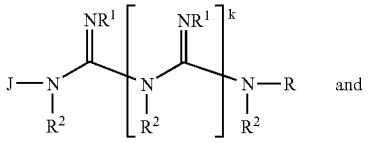

and (II)

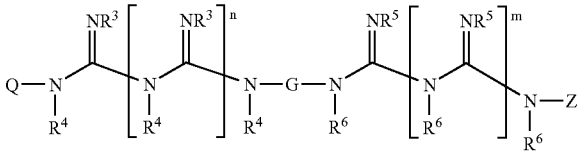

wherein, k, n and m are each independently an integer from 0–4,

J, Q and Z are each independently a monocyclic or bicyclic carbocyclic aromatic group which can be substituted by 1 to 5 members selected from the group consisting of hydrogen, hydroxyl, halo, alkoxy, alkyl, amino, carboxy, acetoxy, cyano and sulfhydryl, G is a bivalent $C_1$–$C_{12}$ straight or branched chain alkyl, alkenyl or alkynyl linking group which can be substituted in the carbon chain by 1 to 4 members selected from the group consisting of O, S, N atoms and 1–12 of the hydrogen atoms on the carbon chain may be replaced independently by a member selected from the group consisting of hydroxyl, halo, alkoxy, alkyl, amino, carboxy, acetoxy, cyano and sulfhydryl, One preferred such coating composition as described above is wherein the dye fixing compound has the following formula (II)a:

(II)a

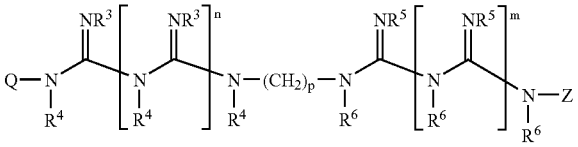

wherein each of Q and Z is a member selected from the group consisting of phenyl substituted by 1 to 3 members selected from the group consisting of hydrogen, hydroxyl, halo, alkoxy, alkyl, amino, carboxy, acetoxy, cyano and sulfhydryl, and p is an integer from 1–20, or a salt thereof.

The coating composition as described above, wherein each of $R^3$, $R^4$, $R^5$ and $R^6$ is hydrogen, p is an integer from 4–8, and each of Q and Z is a phenyl group substituted in the para position by a halo group, or a salt thereof. Preferred are such compositions wherein each of Q and Z is a phenyl group substituted in the para position by a chloro group, p is the integer 6, or a salt thereof.

In another embodiment of the coating composition as described above is wherein the dye fixing compound has the following formula:

(I)

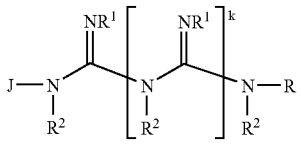

wherein:

k is the integer from 0–4,

J is a member selected from the group consisting of phenyl substituted by 1 to 3 members selected from the group consisting of hydrogen, hydroxyl, halo, alkoxy, alkyl, amino, carboxy, acetoxy, cyano and sulfhydryl, R is a $C^1$–$C^{12}$ straight or branched chain alkyl group, or a salt thereof.

Preferred such coating composition comprising the compound of Formula I as described above is wherein each of $R^1$ and $R^2$ is hydrogen, J is a phenyl group substituted in the para position by a halo group, and R is a member selected from the group consisting of a methyl group, an ethyl group, an n-propyl group, an isopropyl group, an n-butyl group, a t-butyl group, an n-pentyl group, an amyl and an isoamyl group, k is the integer 1, or a salt thereof. More preferred are such compositions wherein J is a phenyl group substituted in the para position by a chloro group, and R is an isopropyl group, or a salt thereof.

In another embodiment of the coating composition, as described above, the dye fixing compound is a member selected from the group consisting of Formula III or VI (III)

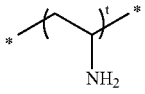

Polyvinylamine
PVAM (IV)

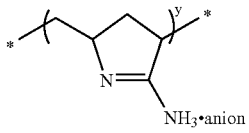

Polyamidine
PVAD wherein:

each * symbol in the formula refers to a polymer terminating group such as a hydrogen atom, or any other acceptable polymer terminating group, and t and y are each independently an integer of sufficient size to provide a polymer having a mean molecular weight between 2,000 and 200,000.

In one embodiment the present invention yields a method for providing a water-resistant image on paper using an ink-jet printer, comprising:

(a) applying to the surface of a pre-sized paper substrate a coating composition as described above; and (b) applying a dye composition to the coated substrate, wherein the dye composition contains a reactive dye having ionizable and/or nucleophilic groups capable of reacting with the coating agent.

A preferred embodiment of such a process as described above is wherein the dye composition is an aqueous based ink, wherein aqueous based means that an aqueous solution can contain one or more aqueous miscible organic solvents.

The invention also provides a printed paper product prepared by the method described above utilizing the above described coating composition.

The various components of the coating composition will now be described.

1. Coating Agents

The coating agents are as described above. In some embodiments of the invention, it is important that the pH of the coating composition be acidic, as some compositions can tend to gel at basic pH. In such cases, if necessary, an acid should be added to the composition to ensure that the pH is below 7.0, preferably less than about 5.5, and most preferably in the range of about 1.0 to 5.5. Suitable acids include sulfuric acid, hydrochloric acid, acetic acid, and the like.

2. Film-Forming Binders

The coating compositions of the invention preferably include a film-forming binder. By "film-forming binder" is meant a substance that provides for improved strength of a paper substrate upon application of the substance to the substrate. "Film-forming binders" used in connection with the coating compositions of the invention include any film-forming binder that is compatible with the selected coating agent and other components of the coating composition. Exemplary film-forming binders include, but are not necessarily limited to: polysaccharides and derivatives thereof, e.g., starches, cellulosic polymers, dextran and the like; polypeptides (e.g., collagen and gelatin); and synthetic polymers, particularly synthetic vinyl polymers such as poly (vinyl alcohol), poly(vinyl phosphate), poly(vinyl pyrrolidone), vinyl-pyrrolidone-vinyl acetate copolymers, vinyl alcohol-vinyl acetate copolymers, vinyl pyrrolidone-styrene copolymers, and poly(vinyl amine), and cationic film-forming binders such as quaternized vinyl pyrrolidone-dimethylaminoethyl-methacrylate copolymer, dimethylaminoethyl-methacrylate-co-methyl methacrylate, polydiallyldimethyl ammonium chloride and quaternized aminoacrylate polymers.

Polysaccharide binders: Starches, as noted above, represent one category of suitable film-forming binders for use herein. Suitable starches may be any of a variety of natural, converted, and synthetically modified starches. Exemplary starches include, but are not necessarily limited to starch (e.g., SLS-280 (St. Lawrence Starch)), cationic starches (e.g., Cato-72 (National Starch), hydroxyalkylstarch, wherein the alkyl has at least one carbon atom and wherein the number of carbon atoms is such that the material is water soluble, preferably from about 1 to about 10 carbon atoms, such as methyl, ethyl, propyl, butyl, or the like (e.g, hydroxypropyl starch #02382 (PolySciences, Inc.), hydroxyethyl starch #06733 (PolySciences, Inc.), Penford Gum 270 and 280 (Penford), and Film-Kote (National Starch)), starch blends (see, e.g., U.S. Pat. No. 4,872,951, describing a blend of cationic starch and starch treated with an alkyl or alkenyl succinic anhydride (ASA), preferably 1-octenyl succinic anhydride (OSA)), and the like. The film-forming binder can also be a synthetically produced polysaccharide, such as a cationic polysaccharide esterified by a dicarboxylic acid anhydride (see, e.g., U.S. Pat. No. 5,647,898). Additional saccharide binders include cellulosic materials such as alkyl celluloses, aryl celluloses, hydroxy alkyl celluloses, alkyl hydroxy alkyl celluloses, hydroxy alkyl celluloses, dihydroxyalkyl cellulose, dihydroxyalkyl cellulose, hydroxy alkyl hydroxy alkyl cellulose, halodeoxycellulose, amino deoxycellulose, dialkylammonium halide hydroxy alkyl cellulose, hydroxyalkyl trialkyl ammonium halide hydroxyalkyl cellulose, dialkyl amino alkyl cellulose, carboxy alkyl cellulose salts, cellulose sulfate salts, carboxyalkylhydroxyalkyl cellulose and the like). Still additional film-forming binders of this type include dextran (e.g., dialkyl aminoalkyl dextran, amino dextran, and the like), carrageenan, Karaya gum, xanthan, guar and guar derivatives, (e.g., carboxyalkyl hydroxyalkyl guar, cationic guar, and the like), and gelatin.

Additional exemplary film-forming binders include resins (e.g., such as formaldehyde resins such as melamine-formaldehyde resin, urea-formaldehyde resin, alkylated urea-formaldehyde resin, and the like), acrylamide-containing polymers (e.g., poly(acrylamide), poly(N,N-dimethyl acrylamide), and the like), poly(alkyleneimine)-containing polymers (e.g., poly(ethyleneimine), poly(ethyleneimine)epichlorohydrin, alkoxylated poly(ethyleneimine), and the like), polyoxyalkylene polymers (e.g, poly(oxymethylene), poly(oxyethylene), ethylene oxide/propylene oxide copolymers, ethylene oxide/2-hydroxyethyl methacrylate/ethylene oxide and ethylene oxide/hydroxypropyl methacrylate/ethyleneoxide triblock copolymers, ethylene oxide-4-vinyl pyridine/ethylene oxide triblock copolymers, ethylene oxide-isoprene/ethylene oxide triblock copolymers, epichlorohydrin-ethylene oxide copolymer, and the like), etc. Other examples are film forming binders comprising 2-hydroxyethylmethacrylate copolymer or terpolymer, or a derivative thereof.

Examples of 2-hydroxyethylmethacrylate copolymer or terpolymer, or a derivative thereof, are wherein the copolymer or terpolymer is at least one member of the group consisting of 2-hydroxyethylmethacrylate/co-acrylic acid copolymer, 2-hydroxyethylmethacrylate/methacrylic acid copolymer, 2-hydroxyethyl-methacrylate/dimethylaminopropylmethacrylate, 2-hydroxyethylmethacrylate/dimethylaminoethylmethacrylate, and 2-hydroxyethylmethacrylate-vinylpyrrolidone, and the like.

Such film forming binders can further comprise at least one additional film forming binder selected from the group consisting of (a) polyvinyl alcohol or a copolymers comprising vinyl alcohol monomer units, (b) polyvinylpyrrolidone or a copolymer comprising vinylpyrrolidone monomer units, (c) cellulose or a cellulose derivative, (d) starch or a starch derivative, (e) a vinyl acetate polymer or a copolymer comprising vinyl acetate monomer units, and (f) polyethyloxazolidine, or a quaternized derivative thereof.

Any of the above exemplary film-forming binders can be used in any effective relative amounts, although typically the film-forming binder, if present in the proportions as described above in the description of the coating composition proportions. Starches and latexes are of particular interest because of their availability and applicability to paper.

3. Other Coating Composition Components

Additional coating composition components may include, but are not necessarily limited to, inorganic fillers, anti-curl agents, or additional conventional components such as a surfactant, plasticizer, humectant, UV absorber, light fastness enhancer, polymeric dispersant, dye mordant, optical brightener, or leveling agent, as are commonly known in the art. Illustrative examples of such additives are provided in U.S. Pat. Nos. 5,279,885 and 5,537,137. Of particular interest is the inclusion of additional components that provide for a coated substrate having a non-glossy, matte, or glossy surface; as will be appreciated by those skilled in the art, incorporation of a pigment (e.g., silica, calcium carbonate) will generally give rise to a non-glossy surface, while a glossy surface will result in the absence of a pigment (or in the presence of only a small amount of pigment), provided that the underlying substrate surface has a glossy finish at the outset (e.g., is resin coated or the like).

Examples of coating composition are compositions as described above, wherein:

(a) the organic cross-linking agent, when present, is at least one member of the group consisting of an polyamide-epichlorhydrin resin, an epoxy resin composition, an azridine compound, an azeridinium compound, and the like, and (b) the inorganic cross-linking agent, when present, is a member selected from the group consisting of a zirconium compound and boron compounds, and the like.

Preferred are such coating compositions, wherein the polyamide-epichlorhydrin resin is an azetidinium resin, the zirconium compound is ammonium zirconium carbonate, and the boron compound is boric acid.

In one preferred embodiment, the coating compositions as described above are coating compositions in an aqueous solvent or in a mixed solvent of at least one aqueous solvent and at least one aqueous miscible organic solvent The coating compositions may also contain a colorant, e.g., a pigment, dye or other colorant, to provide for whiteness or color of the coated paper substrate. The coating compositions may also further include a crosslinking agent, such as zirconium acetate, ammonium zirconium carbonate, or the like, for intramolecular and/or intermolecular crosslinking of coating agents in the coating composition, and/or a chelating agent such as boric acid. Additional components that may be desirable for use in the coating compositions of the invention, as well as guidance for the use of such components and a general description of paper chemistry, are found in Paper Chemistry, 2nd Edition, Roberts, ed., Blackie Academic & Professional, Glasgow, UK (1994). For example, surfactants, leveling agents, and defoaming agents may also be utilized in the coating compositions.

The coating composition is preferably provided in an aqueous liquid vehicle, that only contains small amounts of a water-soluble organic solvent may be present. However, the aqueous liquid vehicle (generally water) may contain other non-organic compounds which are water soluble (smaller amounts) or water miscible. It may on occasion be necessary to add a solubilizing compound during preparation of the coating composition so that the components dissolve in the aqueous liquid vehicle, e.g., an inorganic base such as ammonia and/or an organic amine. Suitable organic amines include lower alkyl-substituted amines such as methylamine, dimethylamine, ethylamine, and trimethylamine, as well as ethanolamine, diethanolamine, triethanolamine, and substituted ethanolamines, typically lower alkyl-substituted ethanolamines such as N-methyl and N,N-dimethyl ethanolamines, and morpholine. Such compounds are also useful for bringing the pH into the desired range for basic formulations, and, if present, will generally represent not more than about 20 wt. % of the composition, and in most cases will represent not more than about 10 wt. % of the composition.

Application of Coating Compositions to Paper Substrates

The coating compositions of the invention can be applied to a substrate, e.g., a paper substrate, by any of a number of conventional processes commonly employed in the art. The substrate as defined above can be make of natural or synthetic fibers or of simply pressed or molded solids, in addition sheets of substrate can be woven such as in fabric or canvas, and can optionally be a coated substrate prior to use of the present coating composition. In essence, the base stock or fibrous cellulosic substrate to be coated in accordance with the present invention can be one of a wide variety of types depending upon the intended use of the final product. The paper substrate is optionally pre-sized, either internally or externally, and can vary in weight from lightweight papers to the heavier paperboards. However, where the coating is applied on-machine, in order to achieve acceptable manufacture speeds (e.g., 100 to 3000 ft./per minute), it is recommended that the weight of the paper base be greater than 30 grams per square meter. When the final product is to exhibit gloss at a satisfactory level (generally greater than 50), the base sheet, before it receives the top coating, should retard rapid drainage of the water or of the coating into the fibrous substrate. One way to accomplish this is by sizing the sheet, either internally or externally but generally externally. Preferably, external sizing is included in an intermediate impregnation coating which serves as a base for the top coating. The paper substrate can be texturized before or after coating to give different surface grains (e.g., such as molding or stamping a texture on the substrate).

The coating composition layer can range in thickness from several hundred Angstroms to several mils in thickness, e.g., in the range of approximately 100 Angstroms to 5 mm; typical amounts of the coating composition to be applied generally range from about 50 to about 500 pounds per ton of substrate, or about 2 to 30 g/m.sup.2. In one embodiment, the coating composition is applied so that it does not substantially infiltrate into the substrate (e.g., the substrate is of a porosity such that the coating composition does not substantially penetrate beyond or far beyond the substrate surface). Application of a coating in a selected thickness can readily be done by one of skill in the art using known techniques, for example, by varying the coating agent concentration and number of coatings and through selection of the application means.

The coating composition as described above is applied to any desirable paper substrate, usually to a type of pre-sized paper substrate commonly used in printing. Substrates for use in the invention include cellulose and non-cellulose type substrates (e.g., synthetic fibers such as polyamides, polyesters, polyethylene, and polyacrylic fibers; inorganic fibers such as asbestos, ceramic, and glass fibers), and/or any combination of cellulosic, synthetic, and inorganic fibers, with porous cellulose substrates being preferred. Preferred substrate for use herein is generally free cut sheet paper, with exemplary paper substrates including, but not limited to, copier grade paper, business card stock, resin-coated papers, cartons such as milk cartons and cardboard gift boxes. Additional exemplary substrates for use in the invention include polyester films such as "MYLAR" flexible film, polysulfones, polyvinyls, cellulose triacetates, and the like. Coated transparent films are also contemplated. Woven fabrics or simulated woven fabrics may also be used as the substrate. Molded sheets can be utilized. Further the paper substrate can have one or more adhesive layers which are optionally removable, before or after printing.

Processes for coating pre-sized paper substrates are well known in the art, and can be performed either on-machine, as alluded to above, or off-machine, i.e., subsequent to completion of paper manufacture. Generally, coating is accomplished by dip coating, reverse roll coating, extrusion coating, saturation, and the like.

Method for Providing Water-Resistant Images on Coated Paper

The invention also features a method for providing a water-resistant (e.g., water-fast) printed image on paper by first applying to the surface of a paper substrate a coating composition of the invention to produce a coated substrate, and then applying a colorant to the coated substrate, where the colorant contains reactive ionizable and/or nucleophilic groups capable of reacting with the coating agent.

In general, aqueous inks are used in the preparation of a printed image on the coated paper substrates of the invention. The aqueous ink may be any suitable ink having a colorant, e.g., a pigment, dye, or stain, having one or more reactive groups suitable for reacting, either covalently or ionically, with a colorant-reactive component of the coating agent present on the coated paper substrate. The selection of the specific ink and colorant will vary with the colorant-reactive component of the coating agent used in the coating composition. For example, when the colorant-reactive component is an azetidinium group, the colorant preferably has a nucleophilic group for reaction with the azetidinium group. Thus, preferred colorants for use in printing on a coated paper substrate having an azetidinium polymer in the polymer coating are those containing one or more nucleophilic moieties, e.g., having an amino, carboxy, sulfonato, thiosulfonato, cyano, hydroxy or sulfido group or the like. Preferred colorants for use in printing a paper substrate coated with a guanidine polymer are those containing an anionic group, e.g., having a carboxy, sulfonato, thiosulfonato, cyano, halo, or phosphonato group or the like.

The inks used in conjunction with the coated paper substrate of the invention may be inkjet inks. Water-soluble colorants in the inkjet inks may be acid dyes, direct dyes, basic dyes or dispersive dyes; preferred dyes for use in the invention are described in U.S. Pat. Nos. 5,425,805, 5,537,137, and 5,441,561.

The selection of the aqueous based ink will depend upon the requirements of the specific application, such as desired surface tension, viscosity, drying time, the type of paper substrate upon which the ink is to be applied (printing medium), and the like. The aqueous liquid vehicle of inks suitable for use in the invention will generally be deionized water, although other nonorganic compounds which are either water soluble or water miscible may be included as well. The colorant may be dissolved, dispersed or suspended in the aqueous liquid vehicle, and is present in an amount effective to provide the dried ink with the desired color and color intensity.

In some instances, the dye is contained in a carrier medium composed of ink and a water soluble organic solvent. For applications utilizing such a carrier medium, representative solvents include polyols such as polyethylene alcohol, diethylene glycol, propylene glycol, and the like. Additional solvents are simple alcohols such as ethanol, isopropanol and benzyl alcohol, and glycol ethers, e.g., ethylene glycol monomethyl ether, diethylene glycol monoethyl ether. Representative examples of water soluble organic solvents are described in U.S. Pat. Nos. 5,085,698 and 5,441,561.

Preferred colorants contained in the inks useful with the invention are dyes, including azo or "direct" dyes as well as dyes containing acidic groups (e.g., carboxylate, phosphonate or sulfonate moieties), basic groups (e.g., unsubstituted amines or amines substituted with 1 or 2 alkyl, typically lower alkyl, groups), or both. Specific examples of suitable colorants include, but are not limited to, the following: Dispersol Blue Grains (Zeneca, Inc.), Duasyn Acid Blue (Hoechst Celanese), Duasyn Direct Turquoise Blue (Hoechst Celanese), Phthalocyanine blue (C.I. 74160), Diane blue (C.I. 21180), Pro-jet Cyan 1 (Zeneca, Inc.), Pro-jet Fast Cyan 2 (Zeneca, Inc.), Milori blue (an inorganic pigment equivalent to ultramarine) as cyan colorants; Dispersol Red D-B Grains (Zeneca, Inc.), Brilliant carmine 6B (C.I. 15850), Pro-jet magenta 1 (Zeneca, Inc.), Pro-jet Fast magenta 2 (Zeneca, Inc.), Brilliant Red F3B-SF (Hoechst Celanese), Red 3B-SF (Hoechst Celanese), Acid Rhodamine (Hoechst Celanese), Quinacridone magenta (C.I. Pigment Red 122) and Thioindigo magenta (C.I. 73310) as magenta colorants; Dispersol Yellow D-7G 200 Grains (Zeneca, Inc.), Brilliant yellow (Hoechst Celanese), Pro-jet yellow 1 (Zeneca, Inc.), Pro-jet Fast Yellow 2 (Zeneca, Inc.), benzidine yellow (C.I. 21090 and C.I. 21100) and Hansa Yellow (C.I. 11680) as yellow colorants; organic dyes; and black materials such as carbon black, charcoal and other forms of finely divided carbon, iron oxide, zinc oxide, titanium dioxide, and the like. Specific and preferred black colorants include Acid Black 48 (Aldrich), Direct Black 58756 A (Crompton & Knowles), BPI Molecular Catalytic Gray (Brain Power), Fasday Cool Gray (Hunter Delator), Dispersol Navy XF Grains (Zeneca, Inc.), Dispersol Black CR—N Grains (Zeneca, Inc.), Dispersol Black XF Grains (Zeneca, Inc.), Disperse Black (BASF), Color Black FW18 (Degussa), Color Black FW200 (Degussa), Hostafine Black TS (Hoechst Celanese), Hostafine Black T (Hoechst Celanese), Duasyn Direct Black (Hoechst Celanese), Pro-jet Black 1 (Zeneca, Inc.) and Pro-jet Fast Black 2 (Zeneca, Inc.).

Printed Coated Paper

The invention also features a printed, coated paper substrate produced using the methods and compositions described herein. The printed, coated paper substrate of the invention can be produced by any of a variety of printing techniques, including inkjet printing, laserjet printing, photocopying, and the like. In general, the printing process involves applying an aqueous recording liquid to a coated paper substrate in an imagewise pattern. Inkjet printing processes are well known in the art; see, e.g., U.S. Pat. Nos. 4,601,777; 4,251,824; 4,410,899; 4,412,224; and 4,532,530.

The coated paper substrates of the invention can also be used in printing and/or copying process using dry or liquid electrophotographic-type developers, such as electrophotographic processes, ionographic process, and the like. The coated paper substrates of the invention can in addition be used in a process for generating images that involves generating an electrostatic latent image on an imaging member in an imaging apparatus, developing the latent image with a toner, and transferring the developed image to a coated paper substrate of the invention. Electrophotographic processes are known in the art, see, e.g., U.S. Pat. No. 2,297,691.

Ionographic and electrographic processes are also well known in the art, see, e.g., U.S. Pat. Nos. 3,611,419; 3,564,556; 4,240,084; 4,569,584; 2,919,171; 4,524,371; 4,619,515; 4,463,363; 4,254,424; 4,538,163; 4,409,604; 4,408,214; 4,365,549; 4,267,556; 4,160,257; and 4,155,093.

The coated paper substrate of the invention can also be used in any other printing or imaging process, such as printing with pen plotters, handwriting with ink pens (either aqueous or nonaqueous based inks), offset printing processes, and the like.

Experimental

The following examples are put forth so as to provide those of ordinary skill in the art with a complete disclosure and description of how to prepare and use the compounds disclosed and claimed herein. Efforts have been made to ensure accuracy with respect to numbers (e.g., amounts, temperature, etc.) but some errors and deviations should be accounted for. Unless indicated otherwise, parts are parts by weight, temperature is in degree. C. and pressure is at or near atmospheric.

Generic examples of coating compositions according to the invention are obtained as follows:

Generic Example A a) Film forming binders from about 75 wt. % to 95 wt. % (e.g., 65 wt. % of 2-hydroxyethyl-co-acrylic acid and 20 wt. % of dimethylaminoethyl methacrylate (DMAEMA)), b) Dye fixing agent from about 1 wt. % to about 40 wt. % (e.g., 12 wt. % of a chlorhexidine gluconate salt), c) Polymer cross-linking agent from about 1 wt. % to about 20 wt. % (e.g., Polycup (172), which is an azetindinium compound), d) Surfactants and leveling agents from about 0.5 wt. % to 2 wt. % each (e.g., about 1 wt. % each of surfactants and leveling agents).

Generic Example B

This generic example has the same components as in Generic Example A, except that the about 20 wt. % of the film-forming binder DMAEMA is quaternized (GAFQUAT, INCI Name=Polyquaternium-11)

Also, in these examples, unless otherwise stated, the abbreviations and terms employed have their generally accepted meanings. Abbreviations and tradenames are as follows (note that suppliers of each material are indicated as well):

Azetidinium polymer is "Polycup 172 (Hercules, Inc.)

Aziridine cross linker "Neocryl-CX 100 (Avecia)

Gaufquat is "Gaufquat 755" (ISP)

WORKING EXAMPLES

Examples 1–7, below, are optionally useful as single layer coating compositions, or may be utilized with the as at least one top coat after at least one undercoating utilizing one or more base coating with a composition according to Examples 1A–4A, below.

Example 1

Containing only Chlorohexidine as Dye Fixative

| | | |
|---|---|---|
| Hydroxyethyl methacrylate copolymer | (~25 wt %) | 15 parts |
| Quarternized acrylic copolymer | (~20 wt %) | 20 parts |
| Chlorohexidine salt | (20 wt %) | 10 parts |
| Isopropanol | | 20 parts |
| Water | | 34 |
| Surfactants | | 1 part |

Example 2

Containing Chlorohexidine and Polyvinyl Amidine as Dye Fixatives

| | | |
|---|---|---|
| Hydroxyethyl methacrylate copolymer | (~25 wt %) | 10 parts |
| Quarternized acrylic copolymer | (~20 wt %) | 25 parts |
| Chlorohexidine salt | (20 wt %) | 5 parts |
| Polyvinyl amidine polymer | (25 wt %) | 10 parts |
| Isopropanol | | 25 parts |
| Water | | 24 parts |

Example 3

Containing Chlorohexidine and Poly Biguanidine as Dye Fixatives

| | | |
|---|---|---|
| Hydroxyethyl methacrylate copolymer | (~25 wt %) | 18 parts |
| Quarternized acrylic copolymer | (~20 wt %) | 20 parts |
| Chlorohexidine salt | (20 wt %) | 6.0 parts |
| Poly biguanidine polymer | (20 wt %) | 16 parts |
| Isopropanol | | 22 parts |
| Water | | 27 parts |
| Surfactants | | 1 part |

Example 4

Containing Chlorohexidine and Azetidinium Polymer

| | | |
|---|---|---|
| Hydroxyethyl methacrylate copolymer | (~25 wt %) | 30 parts |
| Quarternized acrylic copolymer | (~20 wt %) | 15 parts |
| Chlorohexidine salt | (20 wt %) | 10 parts |
| Polyamide-epichlorohydrin polymer | (12.5 wt %) | 5 parts |
| Isopropanol | | 20 parts |
| Water | | 19 parts |
| Surfactants | | 1 part |

Example 5

Containing Chlorohexidine and Azetidinium Polymer

| | | |
|---|---|---|
| Hydroxyethyl methacrylate copolymer | (~25 wt %) | 16 parts |
| Quarternized acrylic copolymer | (~20 wt %) | 20 parts |
| Chlorohexidine salt | (20 wt %) | 6 parts |
| Polyamide-epicholorohydrin polymer | (12.5 wt %) | 4 parts |
| Isopropanol | | 25 parts |
| Water | | 28 parts |
| Surfactants | | 1 part |

Example 6

Containing Chlorohexidine and Azetidinium Polymer

| | | |
|---|---|---|
| Hydroxyethyl methacrylate copolymer | (~25 wt %) | 10 parts |
| Quarternized acrylic copolymer | (~20 wt %) | 30 parts |
| Chlorohexidine salt | (20 wt %) | 7.5 parts |
| Polyamide-epichlorohydrine polmer | (12.5 wt %) | 5 parts |
| Isopropanol | | 15 parts |

-continued

| | |
|---|---|
| Water | 31.5 parts |
| Surfactants | 1 part |

Example 7

Containing Polyethyl Oxazoline Polymer

| | | |
|---|---|---|
| Polyethyl oxazoline polymers | (10 wt %) | 60 parts |
| Polyamide-epichlorohydrine polymer | (12.5 wt %) | 10 parts |
| Chlorohexidine salt | (20 wt %) | 15 parts |
| Water | | 10 parts |
| Isopropanol | | 4 parts |
| Surfactants | | 1 part |

Two-layered or Multi-layered Construction Coating Compositions

Some of the above Examples 1–7 can be utilized as examples of surface layers when the following can be taken as underlayer coating examples or surface layer coatings.

Example 1A

| | | |
|---|---|---|
| Hydroxyethyl methacrylate copolymer | (25 wt %) | 35 parts |
| Polyamide-epichlorohydrine polymer | (12.5 wt %) | 10 parts |
| Isopropanol | | 20 parts |
| Water | | 34 parts |
| Surfactants | | 1 part |

Example 2A

| | | |
|---|---|---|
| Hydroxyethyl methacrylate copolymer | (25 wt %) | 20 parts |
| Polyvinyl amidine | (25 wt %) | 12 parts |
| Isopropanol | | 20 parts |
| Water | | 47 parts |
| Surfactants | | 1 part |

Example 3A

| | | |
|---|---|---|
| Hydroxyethyl methacrylate copolymer | (~25 wt %) | 25 parts |
| Polyamide-Epichlorohydrine polymer | (12.5 wt %) | 5 parts |
| Polyvinyl amidine | (25 wt %) | 5 parts |
| Isopropanol | | 20 parts |
| Water | | 44 parts |
| Surfactants | | 1 part |

Example 4A

| | | |
|---|---|---|
| Hydroxyethyl methacrylate copolymer | (~25 wt %) | 15 parts |
| Quarternized acrylic copolymer | (~25 wt %) | 20 parts |
| Polyamide-epichlorohydrine polymer | (12.5 wt %) | 5 parts |
| Isopropanol | | 20 parts |
| Water | | 39 parts |
| Surfactants | | 1 part |

Without further description, it is believed that one of ordinary skill in the art can, using the preceding description, make and utilize the compositions of the present invention and practice the claimed methods. The examples of coating compositions and methods as well as their proportions, specifically point out preferred embodiments of the present invention, and are not to be construed as limiting in any way the remainder of the disclosure. Such examples are non-limiting in that one of ordinary skill (in view of the above) will readily envision other permutations and variations on the invention without departing from the principal concepts. Such permutations and variations are also within the scope of the present invention.

What is claimed is:

1. A process for coating a solid substrate selected from the group consisting of paper, resin-coated paper, polymeric films, and flexible or inflexible woven fabric, comprising applying to one or both surfaces of the substrate a coating composition comprising an effective amount of at least one ink receptive surface coating composition or agent comprising a dye fixing compound of formula (II)

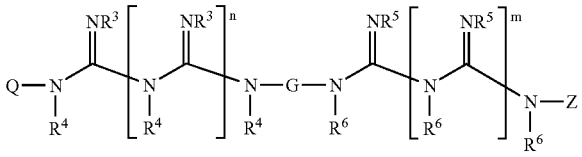

wherein, n and m are each independently an integer from 0–4,

Q and Z are each independently a mono-carbocyclic or bicyclic-carbocyclic aromatic group which can be substituted by 1 to 5 members selected from the group consisting of hydrogen, hydroxyl, halo, alkoxy, alkyl, amino, carboxy, acetoxy, cyano and sulfhydryl, G is a bivalent $C_1$–$C_{12}$ straight or branched chain alkyl, alkenyl or alkynyl linking group which can be substituted in the carbon chain by 1 to 4 members selected from the group consisting of O, S, N atoms and 1–12 of the hydrogen atoms on the carbon chain may be replaced independently by a member selected from the group consisting of hydroxyl, halo, alkoxy, alkyl, amino, carboxy, acetoxy, cyano and sulfhydryl, $R^3$ and $R^5$ are each independently hydrogen or lower alkyl, and $R^4$ and $R^6$ are each independently hydrogen, alkyl, alkoxy or hydroxyl-substituted alkyl, or a salt thereof, and the at least one ink receptive surface coating composition or agent also comprises from 5–95 wt. percent of a film forming binder;

wherein the ink-receptive surface coating composition or agent of may also include at least one organic or inorganic cross-linker, wherein the term polymer refers to a compound having a molecular weight between 2,000 and 200,000, and wherein the salt of the basic nitrogenous moiety of the dye-fixing compound or polymer forms a quaternary ammonium salt, or forms a mixed metallic cation amine salt, with a counter ion selected from the group consisting of an organic or inorganic anion.

2. The process of claim 1, wherein the coating composition or agent comprises chlorhexidine, or a salt thereof.

3. The process of claim 2, wherein the anion of the salt is an anion of an organic acid.

4. The process of claim 2, wherein the anion of the salt is the anion of an alkanoyl group.

5. The process of claim 2, wherein the anion of the salt is a member selected from the group consisting of halide, hydrogen sulfate, acetate, methane sulfonate, succinate, citrate, malonate, furarate, oxylate, gluconate or a gluconate derivative.

6. The process of claim 2, wherein the anion of the salt is gluconate or a gluconate derivative.

7. The process of claim 1, wherein each of Q and Z is a member selected from the group consisting of phenyl substituted by 1 to 3 members selected from the group consisting of hydrogen, hydroxyl, halo, alkoxy, alkyl, amino, carboxy, acetoxy, cyano and sulfhydryl, and n and m are each the integer 1, or a salt thereof.

8. The process of claim 1, wherein the dye fixing compound has the following formula:

(II)

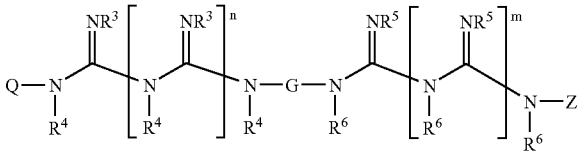

wherein each of Q and Z is a member selected from the group consisting of phenyl substituted by 1 to 3 members selected from the group consisting of hydrogen, hydroxyl, halo, alkoxy, alkyl, amino, carboxy, acetoxy, cyano and sulfhydryl, and each of n and m is the integer 1, or a salt thereof.

9. The process of claim 8, wherein the dye fixing compound has the following formula:

(II)

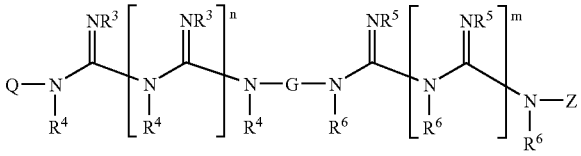

wherein each of Q and Z is a member selected from the group consisting of phenyl substituted in by 1 member selected from the group consisting of hydrogen, hydroxyl, halo, alkoxy, alkyl, amino, carboxy, acetoxy, cyano and sulfhydryl, or a salt thereof.

10. The process according to claim 9, wherein each of $R^3$, $R^4$, $R^5$ and $R^6$ is hydrogen and each of Q and Z is a phenyl group substituted in the para position by a halo group, or a salt thereof.

11. The process of claim 9, wherein the dye fixing compound has the following formula:

(II)a

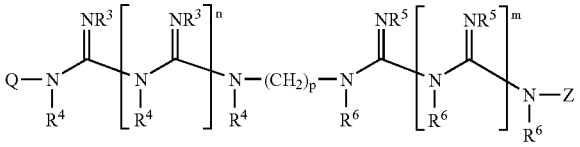

wherein each of Q and Z is a member selected from the group consisting of phenyl substituted by 1 to 3 members selected from the group consisting of hydrogen, hydroxyl, halo, alkoxy, alkyl, amino, carboxy, acetoxy, cyano and sulfhydryl, and p is an integer from 1–20, or a salt thereof.

12. The process according to claim 11, wherein each of $R^3$, $R^4$, $R^5$ and $R^6$ is hydrogen, p is an integer from 4–8, and each of Q and Z is a phenyl group substituted in the para position by a halo group, or a salt thereof.

13. The process according to claim 12, wherein each of Q and Z is a phenyl group substituted in the para position by a chloro group, p is the integer 6, or a salt thereof.

14. The process according to claim 1, wherein the film forming binder comprises a 2-hydroxyethylmethacrylate polymer or copolymer and their derivatives.

15. The process according to claim 14, wherein the 2-hydroxyethylmethacrylate copolymer is at least one member of the group consisting of 2-hydroxyethylmethacrylate-co-acrylic acid, 2-hydroxyethylmethacrylate-methacrylic acid, 2-hydroxyethylmethacrylate dimethylamino-propylmethacrylate, 2-hydroxyethylmethacrylate-dimethylamino-ethylmethacrylate, and 2-hydroxyethylmethacrylate-vinylpyrrolidone, or a quaternized derivative thereof.

16. The process according to claim 15, wherein the film forming binder further comprises one or more additional film forming binders independently selected from the group consisting of (a) polyvinyl alcohol or a copolymers comprising vinyl alcohol monomer units, (b) polyvinylpyrrolidone or a copolymer comprising vinylpyrrolidone monomer units, (c) cellulose or a cellulose derivative, (d) starch or a starch derivative, (e) a vinyl acetate polymer or a copolymer comprising vinyl acetate monomer units, (f) polyethyloxazoline, (g) dimethylaminoethylmethacrylate, and (h) dimethylaminopropylmethacrylate, or a quaternary ammonium salt thereof.

17. The process of claim 1 wherein:

(a) the organic cross-linking agent, when present, is at least one member of the group consisting of an polyamide-epichlorhydrin resin, an epoxy resin composition, an azridine compound or salt, and an azeridinium compound, and (b) the inorganic cross-linking agent, when present, is a member selected from the group consisting of a zirconium compound and boron compounds.

18. The process of claim 17, wherein the amide-epichlorhydrin resin is an azetidinium resin, the zirconium compound is ammonium zirconium carbonate or zirconium acetate, and the boron compound is boric acid.

19. The process of claim 1, wherein the coating composition is aqueous or the composition is in a mixture of an aqueous solvent and one or more aqueous miscible organic solvents.

20. The process of claim 1, wherein the film-forming binder is present in an amount from 30 wt. % to 75 wt. % based on the dry weight of the coating composition.

21. The process of claim 20, wherein the film-forming binder is present in an amount from about 45 wt. % to about 95 wt. % of the coating composition.

22. The process of claim 20, wherein the film-forming binder is selected from the group consisting of polysaccharides, polypeptides, synthetic vinyl polymers, cationic film-forming binders, and derivatives thereof.

23. The process of claim 22, wherein the film-forming binder is a polysaccharide or a derivative thereof.

24. The process of claim 23, wherein the polysaccharide is starch or a starch derivative.

25. The process of claim 23, wherein the polysaccharide is a cellulosic polymer or a derivative thereof.

26. The process of claim 23, wherein the polysaccharide is dextran.

27. The process of claim 22, wherein the film-forming binder is a polypeptide.

28. The process of claim 27, wherein the polypeptide is selected from the group consisting of collagen and gelatin.

29. The process of claim 22, wherein the film-forming binder is a synthetic vinyl polymer or a polyethyloxazoline.

30. The process of claim 29, wherein the synthetic vinyl polymer is selected from the group consisting of poly(vinyl alcohol), poly(vinyl phosphate), poly(vinyl pyrrolidone), vinyl-pyrrolidone-vinyl acetate copolymers, vinyl acetate-acrylic acid copolymers, vinyl alcohol-vinyl acetate copolymers, vinyl pyrrolidone-styrene copolymers, poly(vinylamine) and polyethyloxazolidine.

31. The process of claim 30, wherein the synthetic vinyl polymer is a vinyl pyrrolidone mixed polymer selected from the group consisting of vinylpyrrolidone/dimethylaminoethyl methacrylate copolymer, vinyl caprolactam/vinylpyrrolidone/dimethylaminoethyl methacrylate terpolymer, vinylcaprolactam/vinylpyrroldone/dimethylaminopropyl methacrylamide terpolymer, vinylpyrrolidone/dimethylaminopropyl methacrylamide copolymer, vinlpyrrolidone/dimethylaminoethyl methacrylate copolymer, and quaternized derivatives thereof.

32. The process of claim 22, wherein the film-forming binder is a cationic film-forming binder.

33. The process of claim 32, wherein the cationic film-forming binder is selected from the group consisting of quaternized vinyl pyrrolidone/dimethylaminoethylmethacrylate copolymer, quaternized vinyl pyrrolidone/dimethylaminopropylmethacrylate copolymer, quaternized dimethylaminoethylmethacrylate/co-methyl methacrylate, quaternized polydiallyldimethyl ammonium chloride, quaternized hydroxyethylmethacrylate/di-methylaminopropylmethacrylate, and similar quaternized aminoacrylate polymers.

34. The process of claim 33, wherein the cationic film-forming binder is a salt having as the anion counter-ion a member selected from the group consisting of halide, hydrogen sulfate, acetate, methane sulfonate, succinate, citrate, malonate, fumarate, oxylate, gluconate or a gluconate derivative.

35. The process of claim 1, wherein the film-forming binder is present in an amount from 30 wt. % to 95 wt. % based upon the dry weight of the coating composition.

36. The process of claim 1, wherein the coating composition further includes one or more colorants or an white or black opaque pigment, wherein the colorant is a pigment selected from the group consisting of a silica, alumina, titanium oxide, and the like, or a mixture thereof.

37. The process of claim 1, wherein the ink receptive coating composition or agent represents approximately 5 wt. % to 95 wt. % of the coating composition, based upon total solids weight of the composition after drying.

* * * * *